US007146656B2

(12) United States Patent
Hagan

(10) Patent No.: US 7,146,656 B2
(45) Date of Patent: Dec. 12, 2006

(54) APPARATUS FOR TIPPING A SPA COVER

(76) Inventor: Fred Hagan, 3113 Yorkshire Dr., Bardstown, KY (US) 40004

( * ) Notice: Subject to any disclaimer, the term of this patent is extended or adjusted under 35 U.S.C. 154(b) by 365 days.

(21) Appl. No.: 10/818,587

(22) Filed: Apr. 6, 2004

(65) Prior Publication Data

US 2005/0000010 A1 Jan. 6, 2005

Related U.S. Application Data

(60) Provisional application No. 60/466,304, filed on Apr. 30, 2003.

(51) Int. Cl.
*E04H 4/00* (2006.01)

(52) U.S. Cl. ..... 4/498; 4/503

(58) Field of Classification Search ..... 4/498, 4/500, 503, 580; 16/239; 49/394, 381
See application file for complete search history.

(56) References Cited

U.S. PATENT DOCUMENTS 3,854,149 A * 12/1974 Mischke ..... 4/498
5,517,703 A 5/1996 Ouelette
5,634,218 A 6/1997 Ouelette
5,996,137 A * 12/1999 Genova ..... 4/498
6,000,072 A 12/1999 LaHay
6,195,811 B1 3/2001 Dragovic
6,381,766 B1 5/2002 Perry
6,393,630 B1 5/2002 Tedrick
6,442,799 B1 9/2002 Duarte
6,601,834 B1 8/2003 Perry

* cited by examiner

*Primary Examiner*—Tuan Nguyen
(74) *Attorney, Agent, or Firm*—Charles Lee Thomason; Spalding & Thomason

(57) ABSTRACT

An apparatus for raising and closing a hinged spa cover. A frame assembly extends over the rear panel of a bifold spa cover, and further is pivotally connected to a base assembly. In order to raise the spa cover from the spa tub, the front panel of the spa cover is folded over the rear panel and frame. The frame assembly pivots on the base assembly lifting the folded spa cover to an opened position. A stop connected to the frame assembly contacts the ground as the frame assembly pivots on the base, once the cover reaches a predetermined open position. The reverse steps will lower and close the spa cover onto the spa tub.

18 Claims, 2 Drawing Sheets

APPARATUS FOR TIPPING A SPA COVER

PRIORITY

This application claims priority to U.S. provisional application No. 60/466,304, filed on Apr. 30, 2003.

BACKGROUND

The present invention is an apparatus designed to allow the easy opening and replacement of a cover on a hot tub or spa. Conventional spa covers are bifold design, and include a front and rear panel, the two halves being connected in the middle by a hinge. When the user desires to remove the cover from the spa, he folds the front panel over the back panel, then lifts the cover off, over the side or rear wall of the spa. This removal method places a relatively heavy physical burden on the user.

Spa cover removal systems are known in the art, but those designs places a large amount of stress on the point of attachments to the spa cover, especially at the cover hinge point. Others move the cover down to the ground, which requires lifting force to raise the cover from the ground back into the closed position, and often the prior art designs used springs or dampeners to manage the lifting force.

SUMMARY OF THE INVENTION

This invention is an apparatus for tipping a spa or hot tub cover from the closed to an open position, and then back to the closed position. Specifically, this apparatus is designed for use preferably with bi-fold spa covers. These covers include a front and rear panels, which are connected by a hinge or the equivalent, so that the front panel is to be folded back over the rear panel.

To orient the invention, it is understood that the spa or hot tub has a front and rear wall. The front wall of the spa is the wall opposite the rear, and side walls connect the front and rear walls. The front wall supports an edge of the front panel of the spa cover.

The present invention resides along the rear wall of the spa, and an edge of the rear panel of the spa cover rests on the rear wall of the spa. The frame apparatus lifts the spa cover open to a resting point over the base along the rear wall of the spa.

The above description, as well as other features and advantages of this invention will be better understood in conjunction with the following detailed description of the preferred embodiment which proceeds with reference to the accompanying drawings, wherein the preferred embodiment of the invention is shown and described. It is understood that the invention is capable of various embodiments not described herein, and that its several details are capable of modifications in various obvious respects, all without departing from the invention. Accordingly, the drawings and description are to be regarded as illustrative in nature, and not as restrictive.

DETAILED DESCRIPTION

Figure 1:
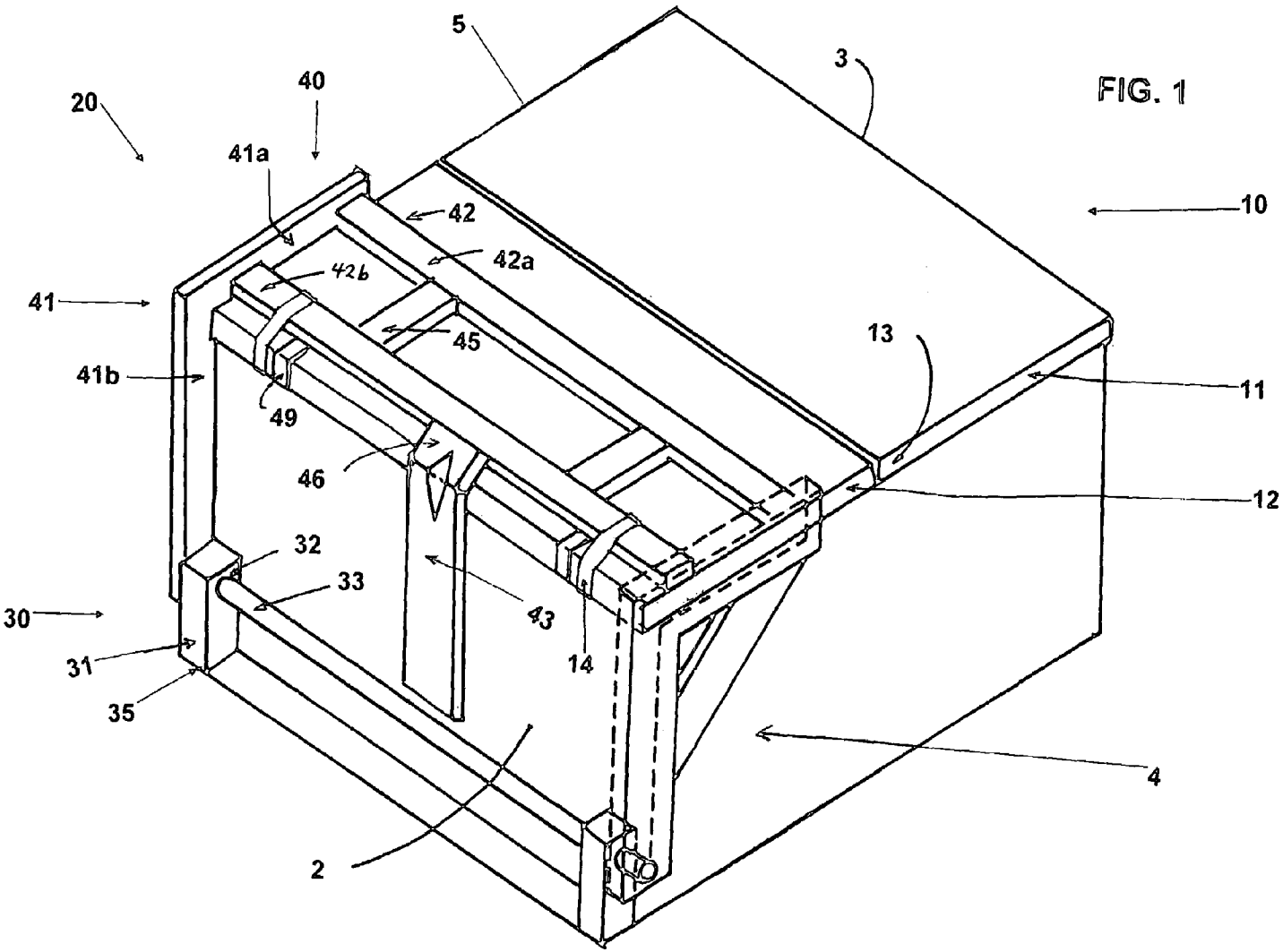
FIG. 1 is a three-quarter side view of the top, side and rear wall of a conventional spa tub with a foldable cover, upon which the invention rests.

The apparatus is comprised of a frame assembly and a base assembly. The base assembly is at the rear wall of the spa, and a pivot point is provided. The frame assembly and the folded cover panels pivot upon the base. The frame assembly comprises a lateral strut, and preferably two struts, extending across the rear panel of the spa cover. A first and a second lateral strut, or together one cross-member, will lay across the rear panel of the spa cover. That first strut is laid more proximate to the bifold cover hinge than the second lateral strut which is laid on the rear panel nearer the edge at the rear wall of the spa. The lateral struts or cross-member extend across the rear panel, then join to the pivot arms that rotate alongside each sidewall of the spa tub. These arms join to the pivot on the base assembly, and may use a pivot beam. When the user desires to tip open the spa cover, the front panel is folded over the rear panel and the lateral members of the frame, then the pivot arms rotate an the cover is tipped up to the raised and open position.

The frame assembly should stay in contact with the spa cover panels, but no screws or drilled-in anchors attach it to the spa cover, a feature which distinguishes this invention over many prior art devices. In the preferred embodiment, the cross-member has edge supports, or brackets, which conform to the planar edge of the rear panel at the rear wall of the spa. These edge supports, or right-angle brackets, extend from the plane of the cover panels and onto the perpendicular edge of the rear panel. In the raised position, the cover panels rest upon these support edges, or brackets, that are connected to the laterals, or cross-member, of the frame assembly.

Also a support stop or leg is attached, typically by a hinge, to the second lateral strut near the rear wall of the spa. The support stop is a member that extends from the second strut, preferably near its midpoint, parallel to the legs on the base assembly. One end of the support stop or leg moves into contact with the ground when the cover panels and frame assembly pivot on the arms as the cover is tipped up to the open position. The support stop or leg means has a predetermined length, that is, when the spa cover is up in the tipped position, the measured distance from the end of the stop that contacts the ground to the end that is attached to the frame strut on the rear panel of cover is a distance preferable for holding the assembly at a point where the cover will not interfere with the use of the spa tub. Thus, the stop or leg supports the cover when the frame has the folded cover tipped open for the spa to be used.

In this manner, the cross-member supports the spa cover in an open position on the frame, base and support stop. The spa cover/frame assembly unit comes to rest at a point such that the spa cover is in an open, usable position but has not traveled to a point where it rests on or near the ground. Rather, it rests at a point where the center of gravity of the spa cover/frame assembly unit is near a point of equilibrium between the open and closed position, biased slightly towards the open position. In this manner, the user can easily tilt the spa cover between the open and closed positions.

The present invention also includes a stop attached to the frame assembly by a hinge. In the preferred embodiment, when the frame assembly pivots relative to the base assembly, the hinged stop or leg on the frame lowers, eventually coming into contact with the ground after a predetermined amount of rotation of the frame assembly. The hinged stop thereby prevents excessive rotation of the spa cover. Further, by virtue of the contact between the hinged stop and the ground when the cover is in the open position, the present invention solves a problem often encountered in the prior art because the points of attachment of the apparatus to the spa, in this case the legs, do not bear the weight of the spa cover when it is in the open position. Rather, the weight is transferred to the ground, thereby extending the life of the spa cover removal apparatus. Further, in achieving this result, the present invention maintains simplicity in both the device itself and the removal process.

The frame assembly may incorporate means for the spa cover to pivot in contact with the struts on the frame assembly. In one preferred embodiment, this means can include one or more straps that holding the frame assembly against the spa cover especially when opened. Similarly, in one preferred embodiment, a rest may be attached atop the rear lateral strut of the frame assembly to provide a support point for the front panel of the spa cover when in the folded position over the rear panel. Also, in the preferred embodiment, a number of other features are included which improve the present invention. For example, feet may connect the legs of the base assembly to the ground or spa deck, thereby distributing the weight of the spa cover to the ground through more points of contact. Other features of the preferred embodiment will be described below.

Figure 2:
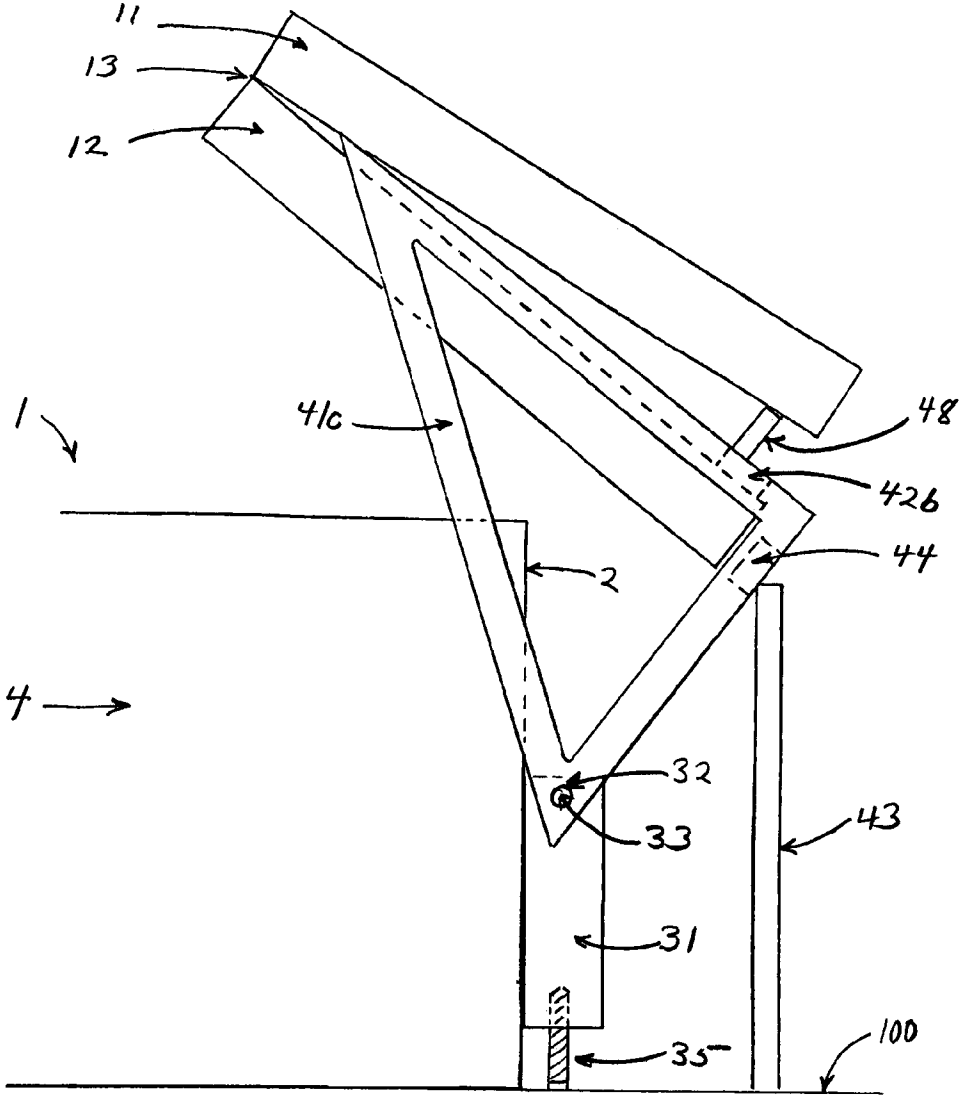
FIG. 2 is side view of the invention with the bifold cover of the spa in the folded and raised position.

FIGS. 1 and 2 show preferred embodiments of the present invention 20. For purposes of clarity, the rear wall of the spa is defined as the wall over which the folded cover 10 is removed, or in the present invention, over which it is tipped open. The front wall is the wall opposite the rear wall, and the side walls 4 and 5 of the spa are defined as the walls that connect the front wall 3 and rear wall 2. The present invention is an apparatus 20 for a spa cover 10, which provides a simple, non-demanding means for tipping open and closing the cover over a spa 1 or hot tub. More specifically, the apparatus 20 is designed for use with the conventional type of bi-fold spa cover 10, which includes a front panel 11 and a rear panel 12 connected by a hinge 13. Without the present invention, a spa user folds open the cover panels 11 and 12 at hinge 13, then the folded cover 11 is lifted off of the spa.

The spa removal and replacement apparatus 20 includes a base assembly 30 of legs 31 and a pivot 32, and a frame assembly 40 comprised of a cross-member and pivot arms 41. The frame assembly 40 has struts that rest upon the rear panel 12 of the spa cover 10 and the frame also is connected to the base assembly 30 at the pivot 32 by arms 41. According to the present invention, when a user desires to remove the spa cover 10, rearward force is applied to pivot the frame assembly 40 about a fixed axis relative to the base assembly 30. The cover and apparatus tip up to a predetermined resting point. Once the predetermined open position has been reached, a motion limiting stop or support 43 prevents over-rotation of the frame assembly 40 and spa cover 10. In the preferred embodiment, the apparatus is made primarily of redwood, however, the apparatus may be made from a variety of materials, including wood, plastic or metal.

The base assembly comprises a plurality of legs 31 attached to the rear wall of the spa. In the preferred embodiment, each of the legs 31 contains a similarly located aperture 32 through which a pivot member 33 passes in a substantially horizontal manner. One preferable pivot member 33 is a galvanized metal bar. More preferably, the galvanized metal bar is about ½" in diameter. The pivot member 33 is adapted to rotate about a fixed axis relative to the legs 31. Preferably, the legs 31 have feet 35, which connect the legs 31 to the ground or spa deck. When the spa cover 10 is in the open position, the legs allow the weight of the apparatus to transfer from the legs 31 to the feet 35.

The frame assembly 40 comprises a plurality of lateral struts 42 that extend across the rear panel 12 of spa cover 20. A first lateral strut 42*a* of the cross-member lays across the rear panel of the spa cover toward the hinge 13 connecting the front panel 11 and the rear panel 12 of the spa cover 10. In this manner, the cross-member 42 will support the spa cover 10 when the front panel 11 is folded over the rear panel 12 and the spa cover 10 is tipped backwards to the open position. Placement of the first strut is along a lateral line that is at or about the center of gravity of the folded cover and apparatus in the tipped open position. A second lateral strut lays across the rear panel of the spa cover, and that rear lateral strut 42*b* is at or near the rear edge of the spa cover. Placement of the struts in relation to hinge on the spa cover and to the rear edge of the cover is predetermined, with several factors given some consideration, including the center or gravity of the folder cover, not having the first strut so close to the hinge that it could "spring" the hinge when the cover is folded over, achieving a resting point for the folded to be placed open over the rear wall, that placement to far rearward may not supply adequate support when the cover is raised in the open position, and other considerations that may depend on the specific construction of the cover and spa. For example, the figures depict the invention with a polygonal shaped spa and cover, but the same principle would apply to a spa that with a rounded outer wall and cover. In one preferred embodiment for a cover that has generally rectangular panels, the forward strut was placed approximately one-fifth of the distance from the hinge to the back edge of the rear panel.

In the preferred embodiment, ribs 45 connect the lateral struts 42 in order to prevent "play" in the frame assembly. These ribs and struts comprise an embodiment of a cross-member. The frame assembly 40 may include means to hold the spa cover 10 in place against the frame assembly 40. In a preferred embodiment, straps 14 maintain the rear panel 12 of the spa cover against the frame assembly cross-member 42, in particular, 42*b*. It is noted that although the frame assembly 40 contacts the spa cover 10, no hardware attaches to the spa cover 10, as is common in the prior art. The present invention avoids the spa cover 10 being drilled, as in the prior art that attaches hardware to or anchors into the cover 10. The prior art use of hardware that attached to the spa cover has lead to failures due to lifting and supporting stresses on the attachment point. Although an embodiment of the present invention could include some element of attachment between the spa cover 10 and the frame assembly 40, it is not necessary or desirable.

The frame assembly may include one or more cover support members on the rear panel to support the spa cover when the cover is in the open position. The weight of the panels of the spa cover 10 is supported by one or more cover support members 49, which attach to the rear lateral strut 42*b* and extends back and along the edge of the rear panel 12. When the spa cover 10 is in the open position, the weight is against these cover support members 49. Preferably, the cover support member 49 is a bracket, or a strip of metal bent at a 90° angle where a first end of bracket 49 is attached to the underside of the rear lateral strut 42*b* and a second end extends down the rear edge of the rear panel 12. This manner of support enables the present invention to avoid the spa cover to be pierced with hardware and to avoid stress on any point of attachment between the spa cover and removal apparatus, a failing common in the prior art. Also, in the preferred embodiment, the edges of cover support member 49 are rounded so that they do not pierce the material of spa cover 10. In FIG. 1, the brackets are shown away from the lateral strut 42*b*, which enables a clearer depiction, however in the preferred embodiment, the strut covers the brackets and is located closer to the rear edge of the rear panel 12. For aesthetic purposes, the cover support member 49 may be made from wrought iron.

The frame assembly further comprises a pair of pivot arms, one along each side wall of the spa. The pivot arms connect to the ends of the lateral struts, or cross-member, and the arms connect to the pivot of the base assembly. In this manner, the frame assembly may be pivoted about a fixed axis relative to the base assembly. Thus, the frame assembly 40 comprises a pair of arms 41 that connect the lateral struts 42 to the pivot 32 and to member 33 on the base. In the preferred embodiment, the pivot arms are a pair of L-shaped members 41, wherein a second segment 41*a* of each of the L-shaped members 41 extends alongside opposing sides of the rear panel 12, and a first segment 41*b* that extends perpendicularly from segment 41*a* and down to the pivot 32, and preferably to pivot member 33 or its equivalent. The first segments 41*b* in FIG. 1 are adapted to receive opposing ends of the pivot member 33. In this manner, the frame assembly 40 is connected to the base assembly 30 by the pivot arms 41. The second segments 41*a* of each L-shaped member join to opposing ends of the cross-member 41 comprised of first lateral strut 42*a* and rear lateral strut 42*b*. In the preferred embodiment, the L-shaped member 41 includes a diagonal support 41*c* to provide additional strength, as well as providing a convenient handhold for a user during raising or lowering of the spa cover 10.

Further, in the preferred embodiment in FIG. 2, the frame assembly 40 comprises a stiffening strut 44 that laterally connects between the second segments 41*b* of L-shaped members 41, thereby providing additional support for the spa cover 10 when it rests open in the tipped position. One preferred embodiment (not shown) also includes a gusset 46 (shown in FIG.1), which connects the stiffening strut 44 to a rear lateral strut 42*b* and thus the stiffening support 44 provides added support for the weight of the spa cover 10 when raised in the open position. In one embodiment, the stiffening support can provide support to the raised panels, equivalent to the cover support members, or alternatively, the cover support members may be located on the stiffening support.

The preferred embodiment also contains a rest 48, which is located atop the rear lateral strut 42*b*. When the front panel 11 of the spa cover 10 is folded back onto the rear panel 12, it may be supported upon the rest 48. Thus, when the spa cover 10 is in the open position, the weight of front panel 11 is supported upon that rest on the frame assembly 40, rather than by the hinge 13 that connects the front and rear panels 11, 12 of the spa cover 10. In one preferred embodiment, flexible straps are sewn to the cover fabric material, and these straps go over the lateral strut 42*b* from the topside to the edge or the underside of the rear panel, which serves to keep the strut in contact with the rear panel, especially when the cover is raised in the open position.

As described above, the preferred embodiment of the present invention allows a user to remove a spa cover 10 by folding the front panel 11 of spa cover 10 over onto the rear panel 12. The user may then apply a rearward force against the frame assembly 40, which will cause the pivot member 33 to rotate about a fixed axis relative to the legs 31. The preferred embodiment of the frame assembly has a support stop 43 that may be hinged to the rear lateral strut 42*b* as in FIG. 1, or in one preferred embodiment, it may be connected to the stiffening support 44 near its midpoint. The support stop 43 transfers some of the weight of the spa cover 10 and the frame assembly 40 to ground. As the pivot member 33 rotates, the hinged stop 43 will lower towards the ground 100. The hinged stop 43 is of predetermined length based on the desired final position of the spa cover 10. Once the hinged stop 43 reaches the ground or spa deck, the predetermined length holds the raised cover and apparatus at the rest point. The hinged stop 43 acts as a motion limiter, which ensures that the spa cover 10 will come to rest in the desired open position. Further, the spa cover/frame assembly apparatus rests in a position where its center of gravity is near a point of equilibrium between the open and closed positions, preferably with a slight bias towards the open position. In the preferred embodiment, the hinged stop 43 contacts the ground at a point where the spa cover 10 has reached an open, usable position but has not come to rest on or near the ground 100. By virtue of the spa cover/frame assembly coming to rest with the center of gravity near the equilibrium point, a user may more easily remove and replace the device. This is especially true with respect to replacement of the spa cover. Commonly in the prior art, the spa cover will come to rest on or near the ground, requiring the user to exert considerable physical effort in lifting the spa cover up and over the side of the tub. However, according to the present invention, a user will need only to apply a slight push to the spa cover/frame assembly unit when it is in the open position to tilt it back onto the top of the spa.

The foregoing description describes the spa as a rectangular unit with four walls, however, the apparatus can be adapted for use with spas that have a round or rounded tub, to the extent that these units have a bifold cover.

In another embodiment of the present invention, the apparatus comprises a base assembly with three legs that are attached to the wall of the hot tub frame wood screws. Four #3×10 wood screws may be inserted into countersunk holes of each legs, through the outer skin of the spa and into the frame of the spa. The legs, of the type depicted as 31, each have a similarly-located aperture 32 through which a bar 33 passes in a substantially horizontal manner parallel to the rear wall of the spa. Preferably, the bar is ½" diameter galvanized metal. The ½" galvanized metal bar acts as a pivot. Each end of the ½" galvanized metal bar is received at by a triangular end piece 41. Each of the triangular end pieces comprises three sides. A first side 41*b* of each end piece receives an end of the ½" galvanized metal bar 33 at its proximate end. The first side extends away from the pivot 32 towards the spa cover 10. The second side 41*a* of each triangular end piece extends perpendicularly away from the distal end of the first side such that it is contiguous to and parallel with opposing sides of the rear portion 12 of the spa cover. The third side 41*c* of each triangular end piece connects the other two sides to form a right triangle.

The second sides of each triangular end piece are connected by a pair of long members 42*a* and 42*b* resting on top of the rear portion 12 of the spa cover. A rest 48 is attached to the rearmost of the long members. When the spa cover is in the open position, the folded back front portion 11 of the spa cover is supported by the rest. The long members are connected by three short pieces 45 resting on top of the rear portion of the spa cover perpendicular to the long members 42. The apparatus further comprises a long member 44 connecting the first side of each of the triangular end pieces. A hinged stop 43 is connected to the long member 44 connecting the first sides of the triangular end pieces. As the spa cover is opened by rotating the triangular end pieces about the ½" galvanized metal bar, the hinged stop 43 hinges out and contacts the ground 100 to stop the top in a predetermined spot.

This embodiment further comprises a gusset 46, which is attached at one end to the rearmost 42*b* of the long wooden members connecting the second arms of the triangular end pieces 41, and is attached at the other end to the long wooden member 44 connecting the first arms 41*b* of the triangular end pieces. The gusset adds stiffness to the apparatus to prevent springiness in the frame when the spa cover is in the open position. A support piece is included which connects the long wooden member connecting the first arms of the triangular end pieces to the ½" galvanized metal bar 33. The support member allows some of the weight of the apparatus to be transferred to the middle, or second, leg when the spa cover is in the open position.

Two cleats 49 are present in this embodiment. The cleats are pieces of flat metal bar bent at 90° and screwed to the underside of the rearmost long wooden member 42*b* connecting the second arms 41*a* of the triangular end pieces. The underside of the wooden member may be routed out so that the metal does not dig into the top. The cleats prevent the top from sliding towards the ground when the top is in the open position. Thus, the cleat 49 supports the rear portion of the spa cover when it is in the open position. Likewise, the rest 48 supports the front portion of the spa cover when it is in the open position. Therefore, when the spa cover is in the open position, both the front and rear portions of the spa cover are supported, relieving stress on the hinge 13 connecting the front and rear portions of the spa cover.

In this embodiment, a threaded insert 35 is made into the bottom of each leg 31. A piece of all-thread rod with a knot on the end may be introduced into each of the threaded inserts. The rods extend from the feet to the ground 100 or spa deck. They have the effect of transferring weight from the legs to the ground. This relieves stress on the points of attachment between the feet and the spa, preventing possible failure. In place of the threaded rod, a foot of some other type may be attached to each of the legs to ground the apparatus.

The ½" galvanized metal bar 33 may be received by the triangular members as follows: one of the triangular end pieces may contain a hole through which the metal bar passes through. The metal bar then passes through the apertures 32 of each of the three legs. The opposing triangular end piece has a depression into which the metal bar is inserted. This depression does not go all the way through to the other side of the triangular end piece, and the metal bar may therefore not pass all the way through the opposing triangular end piece. Once the metal bar is fully inserted through the apertures of the legs and into the depression in the opposing triangular end piece, a long screw, preferably brass, is passed through the through-hole of the first triangular end piece in a direction perpendicular to the metal bar. The metal bar is thus prevented from sliding out of the through-hole of the first triangular end piece. After the metal bar is in place within the apertures of each of the legs, machine screws are passed through the apertures of each leg in a direction perpendicular to the metal bar, and thus, through the metal bar itself. This prevents the ½" galvanized metal bar from pivoting within the legs, but allows the triangular end pieces to pivot about the ½" galvanized metal bar.

The frame, including the long wooden members and short wooden members, may be held to the rear portion of the spa cover by a pair of straps. The straps are often a feature of the spa cover and are normally utilized to hold the cover in place when the spa is not in use. In this embodiment, those straps are pulled around the rearmost of the long wooden members connecting the second arms of the triangular end pieces and fixed to the wooden member. Any method of attaching the strap to the wooden member known in the relevant arts may be used. For instance, a buckle or its equivalent may be used to fasten the strap to the wooden member, or the strap may simply be tacked to the wooden member.

As would be obvious to one of ordinary skill in the art, various alterations and arrangements may be made pursuant to the above described invention without departing from the critical features. All such modifications coming within the spirit and scope of the accompanying claims are claimed.

What is claimed is:

1. An apparatus for tilting open a hinged spa cover, having a rear and a front panel, for a spa comprising:

a base assembly of rigid legs having a pivot;

a frame assembly of trigonal arms and a cross-member with a cover support bracket, said cross-member extending across said rear panel and each end connected to said trigonal arms, said arms connected to said pivot on said base assembly, and a support leg hinged to said cross-member.

2. The apparatus of claim 1, wherein said rear panel of said spa cover has a top side on which said cross-member rests but does not attach to said cover, and said spa cover having a left and right edge alongside which are each said trigonal arm, and a rear edge, each said trigonal arm formed in an L-shape and comprising a first arm member joined to second arm member and a transverse member, said first arm member having a rotatable connection to said leg on said base and said second arm member substantially parallel to said left and right edges of said rear panel.

3. The apparatus of claim 1, wherein said rear panel of said spa cover has a top side on which said cross-member rests, a left and right edge alongside which are each said trigonal arm, and a rear edge that contacts said spa, said cover support bracket having a first planar portion joined to said cross-member and a second planar portion in contact with said rear edge of said rear panel.

4. The apparatus of claim 2, said frame assembly further comprising a stiffening strut connected between said second arm members of said trigonal arms.

5. An apparatus for tipping open a spa cover having a rear panel hinged to a front panel, said spa having side walls and a rear wall below said rear panel of said cover, said apparatus comprising: a frame assembly comprising lateral struts braced to form a frame that rests across said rear panel, and each said strut extending between a pair of trigonal arms substantially parallel to said sidewalls, each said trigonal arm having a first member substantially parallel with said side wall and a second member substantially parallel with said rear panel and a transverse member therebetween, with said lateral struts joined to said second member, and said frame assembly joined to a moveable support stop, and a fixed base next to said rear wall of said spa, said base having a pivot point providing a rotatable connection to said second member of said arms.

6. The apparatus of claim 5, said transverse member comprising a cross-brace between said first and second members of each said arm.

7. The apparatus of claim 5, said frame assembly further comprising a stiffening strut extending between said second members of said pair of arms.

8. The apparatus of claim 7, wherein said support stop is hingedly connected to said stiffening strut.

9. The apparatus of claim 5, said base comprising a pair of bases spaced apart at the rear wall of said spa, and affixed near said rear wall.

10. The apparatus of claim 1, wherein on each said leg, said pivot comprising an aperture through which a pivot bar passes and each end of said pivot arm connects to one of said second members of said arms.

11. The apparatus of claim 5, said frame assembly comprising a rest attached to the rear lateral strut.

12. The apparatus of claim 1, said base assembly including feet which fix said legs to the ground.

13. The apparatus of claim 1 further comprising one or more straps on the frame assembly to maintain the spa cover in close proximity to the cross-member.

14. An apparatus for raising a hinged spa cover with a rear and a front panel for a spa comprising: a base assembly fixed near the base of said spa comprising stationary legs and a pivot; a frame assembly comprising: a cross-member resting upon said rear panel of said spa cover and connected at each end to trigonal arms, said arms connected to said pivot on said base assembly; a support stop attached movably at one end to the frame assembly.

15. The apparatus of claim 1, said trigonal arms comprising a pair of L-shaped members wherein a first segment of each L-shaped member extends along opposing sides of the rear panel of the spa cover and a second segment of each L-shaped member extends perpendicularly away from the spa cover in the direction of said pivot and is received by said pivot, and a transverse member bridged between said first and second segments.

16. The apparatus of claim 14, said frame assembly further comprising a rest attached to said lateral strut.

17. The apparatus of claim 5, said base including feet which fix said legs to the ground.

18. The apparatus of claim 5 further comprising one or more straps on the frame assembly to maintain the spa cover in close proximity to said lateral struts.

* * * * *